United States Patent [19]

Landgraf et al.

[11] 4,184,839

[45] Jan. 22, 1980

[54] ROLLER TRACK FOR PIPES

[75] Inventors: Helmut Landgraf, Duisburg-Rumeln-Kaldenhausen; Klaus Lange, Duisburg, both of Fed. Rep. of Germany

[73] Assignee: Mannesmann Aktiengesellschaft, Dusseldorf, Fed. Rep. of Germany

[21] Appl. No.: 799,209

[22] Filed: May 23, 1977

Related U.S. Application Data

[63] Continuation of Ser. No. 656,206, Feb. 9, 1976, abandoned.

[30] Foreign Application Priority Data

Feb. 7, 1975 [DE] Fed. Rep. of Germany ... 7504668[U]

[51] Int. Cl.[2] ..... F27B 9/14; F27D 3/00

[52] U.S. Cl. ..... 432/124; 432/246; 198/786; 226/189; 414/432

[58] Field of Search ..... 432/5, 6, 11, 124, 153, 432/154, 246, 239, 243, 233-236; 214/19 R, 338, 339; 198/786, 412; 226/189

[56] References Cited

U.S. PATENT DOCUMENTS

| | | | |
|---|---|---|---|
| 1,551,827 | 9/1925 | Ladd | 432/124 |
| 1,834,304 | 12/1931 | Frank et al. | 432/124 |
| 1,872,713 | 8/1932 | Fahrenwald | 432/124 |
| 2,023,126 | 12/1935 | Fahrenwald | 432/239 |
| 2,697,860 | 12/1954 | Anthony | 432/124 |
| 3,215,253 | 11/1965 | Grantham | 198/127 R |
| 3,260,390 | 7/1966 | Morain | 214/339 |
| 3,322,291 | 5/1967 | Smith | 214/339 |
| 3,422,741 | 1/1969 | Fleisher et al. | 226/189 |
| 3,664,531 | 5/1972 | Magnusson et al. | 214/339 |

FOREIGN PATENT DOCUMENTS

| | | | |
|---|---|---|---|
| 28430 | 5/1907 | Austria | 432/239 |
| 1389180 | 1/1965 | France | 432/246 |

*Primary Examiner*—Henry C. Yuen

*Attorney, Agent, or Firm*—Smyth, Pavitt, Siegemund, Jones & Martella

[57] ABSTRACT

The roller track for moving large pipes through a tempering furnace includes two pairs of relatively closely spaced, resiliently mounted rollers disposed in the end zone of the furnace, where any portion of the pipe passing through is hot and has minimum strength on account of the heating.

5 Claims, 2 Drawing Figures

ROLLER TRACK FOR PIPES

This is a continuation, of application Ser. No. 656,206, filed Feb. 9, 1976 now abandoned.

BACKGROUND OF THE INVENTION

The present invention relates to roller tracks for moving large tubes or pipes through a tempering furnace.

Large pipes are often tempered at about 1000° C., for example, in a gas furnace. The pipes must be moved into and out of the furnace and one uses here a roller track constructed from plural pairs of rollers. The pairs of rollers are spaced along the track by a distance which is equal to about one quarter of a normal pipe length.

It was found that during heating the pipe is quite often damaged in the furnace by the last rollers. In particular, the rollers score the pipes and carve grooves or groove-like indentations into the pipe's surface. The reason for the last rollers in the track doing the damage is that the pipe has maximum temperature when engaging these last rollers and the strength of the pipe is reduced accordingly. As the particular temperature to which the pipe is subjected is deemed necessary for carrying out the particular tempering process, it is not possible to just reduce the temperature.

DESCRIPTION OF THE INVENTION

It is an object of the present invention to construct a roller track for moving pipes in tempering furnaces in such a way that the pipes will not be damaged.

It is a specific object of the present invention to improve a roller track for moving pipes through a tempering furnace in which the rollers are arranged in pairs, and the pairs are particularly spaced in the direction of movement of the pipes.

In accordance with the preferred embodiment of the present invention, it is suggested to replace one of the pairs of rollers by two, relatively closely spaced and, at least partially, resiliently mounted pairs of transport rollers; these two pairs are to be disposed near the end of the roller track in the furnace, i.e. where a pipe passing through has maximum temperature and minimum strength on account of the heating. The rolls of these two pairs are preferably mounted on resiliently biased lever arms. The roller track continues before and behind these two pairs in regular fashion, particularly having non-resiliently supported roller pairs. It was found that the invention does, indeed, solve the problem outlined above.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings, in which:

Proceeding now to the detailed description of the drawings, the figures show a tempering furnace 6 with an end portion 7 by means of which large pipes are tempered, for example at 1000° C. The pipes, such as 5, are moved through the furnace in the direction of the arrow by means of a roller track. The roller track is comprised basically of pairs of somewhat obliquely positioned rollers 4, some of which are driven to move the pipes slowly through the furnace, while causing each pipe to rotate about its own axis.

Figure 1:
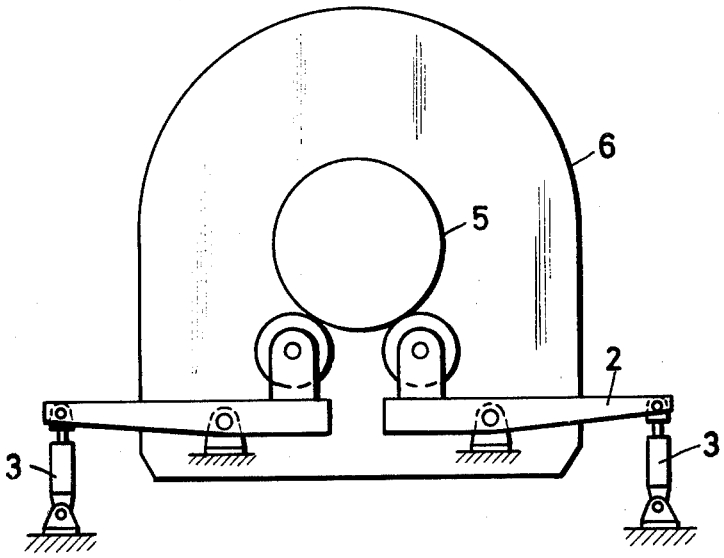
FIG. 1 is a section view of a pipe tempering equipment including a roller track improved in accordance with the preferred embodiment.
Figure 2:
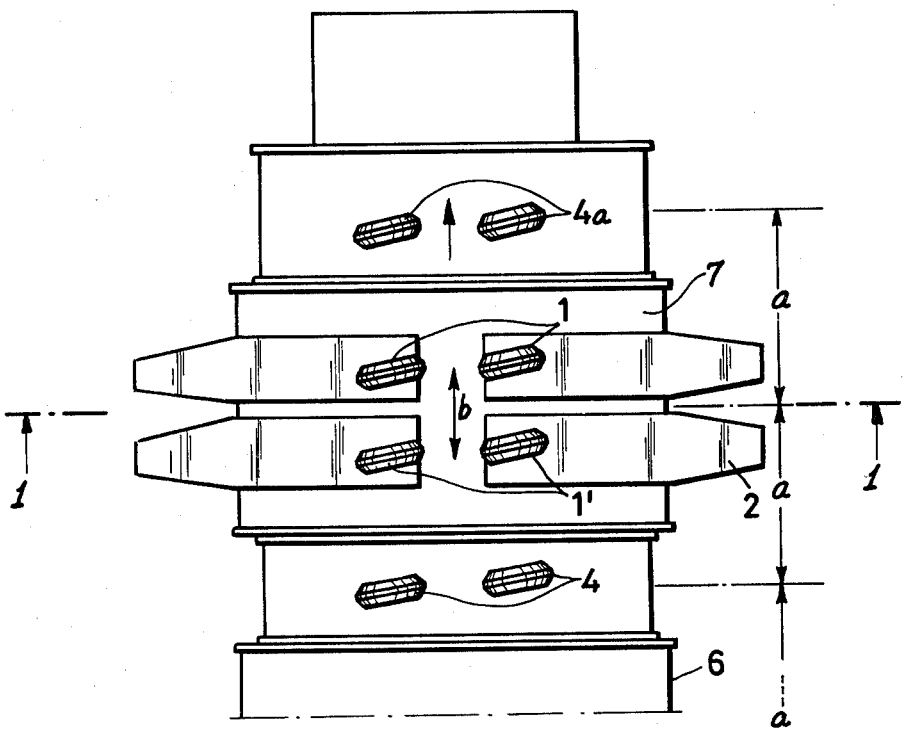
FIG. 2 is an elevational view into the end portion of that furnace including a top view of the roller track.

The rollers or, better, pairs of rollers are particularly spaced in and along the track, the distance being about one quarter of a regular pipe length so that such a pipe is normally supported by four roller pairs. That spacing is denoted in FIG. 2 by character a.

Now, in accordance with the invention, the last roller pair in the furnace is replaced by two roller pairs 1 and 1'. These two pairs 1, 1' are disposed in the end zone portion 7 of the furnace where any pipe portion passing through is the hottest and its strength is reduced more than elsewhere. These two pairs are spaced by a distance b, which is significantly shorter than the regular roller spacing a.

These rollers 1, 1' of the pairs are individually mounted on lever arms 2, which are supported and held in position by resilient devices 3. The resiliency of these devices (coil springs or hydraulic cushions) is adjustable in accordance with the unit length weight of the pipes.

Particularly, in the case of hydraulically obtained resiliency, the cushioning effect is adjustable e.g. through by-pass control or control of throttling. This way the support pressure is readily adjustable, and the rollers take up a portion of the weight forces exerted by the pipe and distribute these forces effectively over a larger (equivalent) area on account of the resiliency.

It can also be seen that non-resilient, regular roller pairs are disposed behind and in front of the two resiliently mounted pairs 1, 1'. The last one of the track shown is already outside of the furnace (4*a*).

The invention avoids the problems outlined above in a rather simple manner. Particularly, the resiliently supported closely spaced support rollers engage the hot pipe without carving grooves into it or damaging the pipe otherwise.

The invention is not limited to the embodiments described above, but all changes and modifications thereof not constituting departures from the spirit and scope of the invention are intended to be included.

We claim:

1. A pipe tempering furnace having a plurality of heating zones with a roller track extending therethrough, the track having a plurality of pairs of rollers for engaging the pipes, the rollers of a pair of the plurality being particularly spaced in a direction transversely to a direction of movement of the pipe in the furnace, most of the pairs being placed in locations of a series of locations being regularly spaced in the direction of movement, the improvement for avoiding scoring the surface of the pipes on the track, comprising:

at least a first one of the locations in the series being located adjacent a zone of maximum heating of the pipe in the furnace having no rollers but being located in about the middle between a first pair and a second pair of rollers; the first and second pairs being spaced from each other by less than said particular spacing, the first pair being located upstream in relation to the second pair, a third pair of rollers of the plurality being disposed in the next upstream location being spaced from the one location by the particular spacing in the series, but being spaced from the first pair of rollers by less than the particular spacing; and means for resiliently supporting the rollers of at least one of the first and second pairs.

2. In a roller track as in claim 1 said means including lever arms for supporting respectively the rollers of the one pair, the lever arms being individually biased.

3. In a roller track as in claim 1, the means including hydraulic means to obtain resilient support.

4. In a roller track as in claim 1, the rollers in said next upstream location being fixed mounted.

5. In a roller track as in claim 1, and including a fourth pair of rollers of the plurality downstream from said first and second pairs, being spaced from said third pair by twice said particular spacing and being also fixedly mounted, said first and second pairs of rollers being disposed between said third and said fourth pairs of fixedly mounted rollers.

* * * * *